US005512991A

United States Patent [19]

Montfort

[11] Patent Number: 5,512,991

[45] Date of Patent: Apr. 30, 1996

[54] RESONATOR ASSEMBLY HAVING AN ANGULARLY SEGMENTED WAVEGUIDE MEMBER

[75] Inventor: David B. Montfort, Penfield, N.Y.

[73] Assignee: Xerox Corporation, Stamford, Conn.

[21] Appl. No.: 338,722

[22] Filed: Nov. 14, 1994

[51] Int. Cl.[6] ..... G03G 15/14

[52] U.S. Cl. ..... 355/273; 310/322

[58] Field of Search ..... 355/271, 273, 355/274; 228/1.1; 310/320–322, 325

[56] References Cited

U.S. PATENT DOCUMENTS

| | | | |
|---|---|---|---|
| 2,836,725 | 5/1958 | Vyverberg | 250/49.5 |
| 3,854,974 | 12/1974 | Gato et al. | 117/17 |
| 4,786,356 | 11/1988 | Harris | 228/1.1 X |
| 4,987,456 | 1/1991 | Snelling et al. | 355/273 |
| 5,005,054 | 4/1991 | Stokes et al. | 355/273 |
| 5,010,369 | 4/1991 | Nowak et al. | 355/273 |
| 5,016,055 | 5/1991 | Pietrowski et al. | 355/273 |
| 5,025,291 | 6/1991 | Nowack | 355/273 |
| 5,081,500 | 1/1992 | Snelling | 355/273 |
| 5,357,324 | 10/1994 | Montfort | 355/273 |

*Primary Examiner*—William J. Royer
*Attorney, Agent, or Firm*—Denis A. Robitaille

[57] ABSTRACT

An apparatus for enhancing toner release from an image bearing member moving in a process direction in an electrostatographic printing machine, including a resonator suitable for generating vibratory energy arranged in line contact with the back side of the image bearing member for uniformly applying vibratory energy to the image bearing member. The resonator includes a piezoelectric transducer and a waveguide member coupled to the transducer for directing high frequency vibratory energy to the image bearing member, the waveguide member being divided along a longitudinal axis of the resonator, forming a plurality of waveguide segments with each waveguide segment being separated by a segmentation slot, the segmentation slot having an orientation generally non-perpendicular to the longitudinal axis of the resonator.

16 Claims, 3 Drawing Sheets

RESONATOR ASSEMBLY HAVING AN ANGULARLY SEGMENTED WAVEGUIDE MEMBER

The present invention relates generally to an apparatus for applying vibratory energy to an imaging surface to enhance toner transfer in an electrostatographic printing machine and, more particularly, relates to a segmented waveguide arrangement for a high frequency resonator useful in applying vibratory energy to an imaging surface in electrostatographic applications.

In a typical electrophotographic printing process, a photoconductive member is initially charged to a substantially uniform potential and the charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy substrate such as a sheet of paper. Thereafter, heat or some other treatment is applied to the toner particles to permanently affix the powder image to the copy substrate. In a final step in the process, the photoreceptive member is cleaned to remove any residual developing material on the photoconductive surface thereof in preparation for successive imaging cycles.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

The process of transferring charged toner particles from an image bearing support surface, such as a photoreceptor, to a second support surface, such as a copy sheet or an intermediate transfer belt, is enabled by overcoming adhesion forces which hold toner particles to the image bearing surface. Typically, transfer of toner images between support surfaces has been accomplished via electrostatic induction using a corona generating device, wherein the second supporting surface is placed in direct contact with the developed toner image on the image bearing surface while the back of the second supporting surface is sprayed with a corona discharge. This corona discharge generates ions having a polarity opposite that of the toner particles, thereby electrostatically attracting and transferring the toner particles from the image bearing surface to the second support surface. An exemplary corotron ion emission transfer system is disclosed in U.S. Pat. No. 2,836,725.

Thus, the process of transferring development materials to a copy sheet in an electrostatographic printing system involves the physical detachment and transfer-over of charged toner particles from an image bearing surface to a second surface through the utilization of electrostatic force fields. The critical aspect of the transfer process focuses on applying and maintaining high intensity electrostatic fields and/or other forces in the transfer region to overcome the adhesive forces acting on the toner particles. Careful control of these electrostatic fields and other forces is required in order to induce the physical detachment and transfer-over of the charged toner particles while maintaining the image configuration thereof and without scattering or smearing of the developer material.

The use of vibratory energy has been disclosed, for example in U.S. Pat. No. 3,854,974 to Sato, et al., among other U.S. Patents, as a method for enhancing electrostatic toner release from an image bearing surface. More recently, systems incorporating a resonator, suitable for generating focused vibratory energy, arranged along the back side of the image bearing surface for applying uniform vibratory energy thereto, have been disclosed. In such systems, toner transfer is enhanced due to the mechanical release of the toner particles from the image bearing surface so that effective toner transfer can occur despite the fact that electrostatic charges in the transfer zone may be insufficient to attract toner from the image bearing surface to the second support surface. Exemplary systems of this nature are disclosed in U.S. Pat. Nos. 4,987,456 to Snelling et al.; 5,005,054 to Stokes et al.; 5,010,369 to Nowak et al.; 5,016,055 to Pietrowski et al.; 5,081,500 to Snelling et al.; and 5,357,324, among other U.S. Patents. The relevant teaching of the identified patents are incorporated in their entirety by reference herein.

As disclosed in U.S. Pat. No. 4,987,456 , a resonator suitable for generating focused vibratory energy generally includes a transducer element coupled to a resonating waveguide member having a contacting tip which is brought into tension or penetration contact with the image bearing belt for coupling the vibratory motion thereto. In systems which incorporate a resonator for applying uniform vibratory energy to the photoreceptor, it has been shown that it may be desirable to provide widthwise slots along the length of the resonator waveguide so as to segment the resonator into individually vibrating portions for providing improvements to process width velocity uniformity. Such segmentation is disclosed in U.S. Pat. No. 5,025,291 to Nowak et at. where the waveguide tip portion is cut perpendicularly to the plane of the image bearing surface, and generally parallel to the direction of travel of the image bearing surface. That patent appears to be particularly relevant to various aspects of the present invention and, therefore, the entire content is incorporated by reference herein.

It is noted that segmentation of the waveguide creates an openended slot between each segment such that each segment acts more or less individually in its response to the transducer. The slots which provide this segmentation cannot exceed a maximum width at the point of contact with the image bearing surface without causing visible streaks and other image defects. As a result, expensive techniques such as precision Electronic Discharge Machining (EDM) must be utilized to provide this segmentation. Moreover, in spite of the use of expensive manufacturing processes, it has been noted that the finite slot width through the waveguide tip can create a disjoining of the inertial energy propagated by the waveguide, resulting in the generation of streaks during the transfer process. The present invention is directed toward providing these slots at an angle relative to the process direction of the image bearing belt so as to provide the application of vibratory energy across the entire width of the belt, eliminating any disjoinder of the energy applied across the width of the belt.

In accordance with one aspect of the present invention, there is provided a resonator assembly for applying uniform vibratory energy to an adjacent surface, comprising a vibratory energy producing element for generating the vibratory energy; and a waveguide member coupled to the vibratory energy producing element for directing the vibratory energy to the adjacent surface, wherein the waveguide member is divided along a longitudinal axis thereof for forming a plurality of waveguide segments, each waveguide segment being separated by a segmentation slot, the segmentation slot having an orientation generally non-perpendicular to the longitudinal axis.

In accordance with another aspect of the present invention, a system for enhancing transfer of toner from an image bearing member moving in a process direction is provided, comprising a resonator assembly adapted to contact the image bearing member, generally transverse to the process direction of movement thereof, for applying uniform vibratory energy thereto, including a vibratory energy producing element for generating the vibratory energy; and a waveguide member coupled to the vibratory energy producing element for directing the vibratory energy to the adjacent surface, the waveguide member being divided along a longitudinal axis thereof for forming a plurality of waveguide segments, each waveguide segment being separated by a segmentation slot having an orientation generally non-parallel to the process direction of movement of the image bearing member.

In accordance with yet another aspect of the present invention, an electrostatographic printing apparatus having a system for enhancing transfer of toner from an image bearing member moving in a process direction is provided, wherein a resonator assembly is adapted to contact the image bearing member, generally transverse to the process direction of movement thereof, for applying uniform vibratory energy thereto. The resonator assembly comprises a vibratory energy producing element for generating the vibratory energy; and a waveguide member coupled to the vibratory energy producing element for directing the vibratory energy to the adjacent surface, the waveguide member being divided along a longitudinal axis thereof for forming a plurality of waveguide segments, each waveguide segment being separated by a segmentation slot having an orientation generally non-parallel to the process direction of movement of the image bearing member.

These and other aspects of the present invention will become apparent from the following description in conjunction with the accompanying drawings, in which.

While the present invention will hereinafter be described in connection with a preferred embodiment and process, it will be understood that it is not intended to limit the invention to that embodiment or process. On the contrary, the following description is intended to cover all alternatives, modifications, and equivalents, as may be included within the spirit and scope of the invention as defined by the appended claims. Other aspects and features of the present invention will become apparent as the following description progresses.

Figure 4:
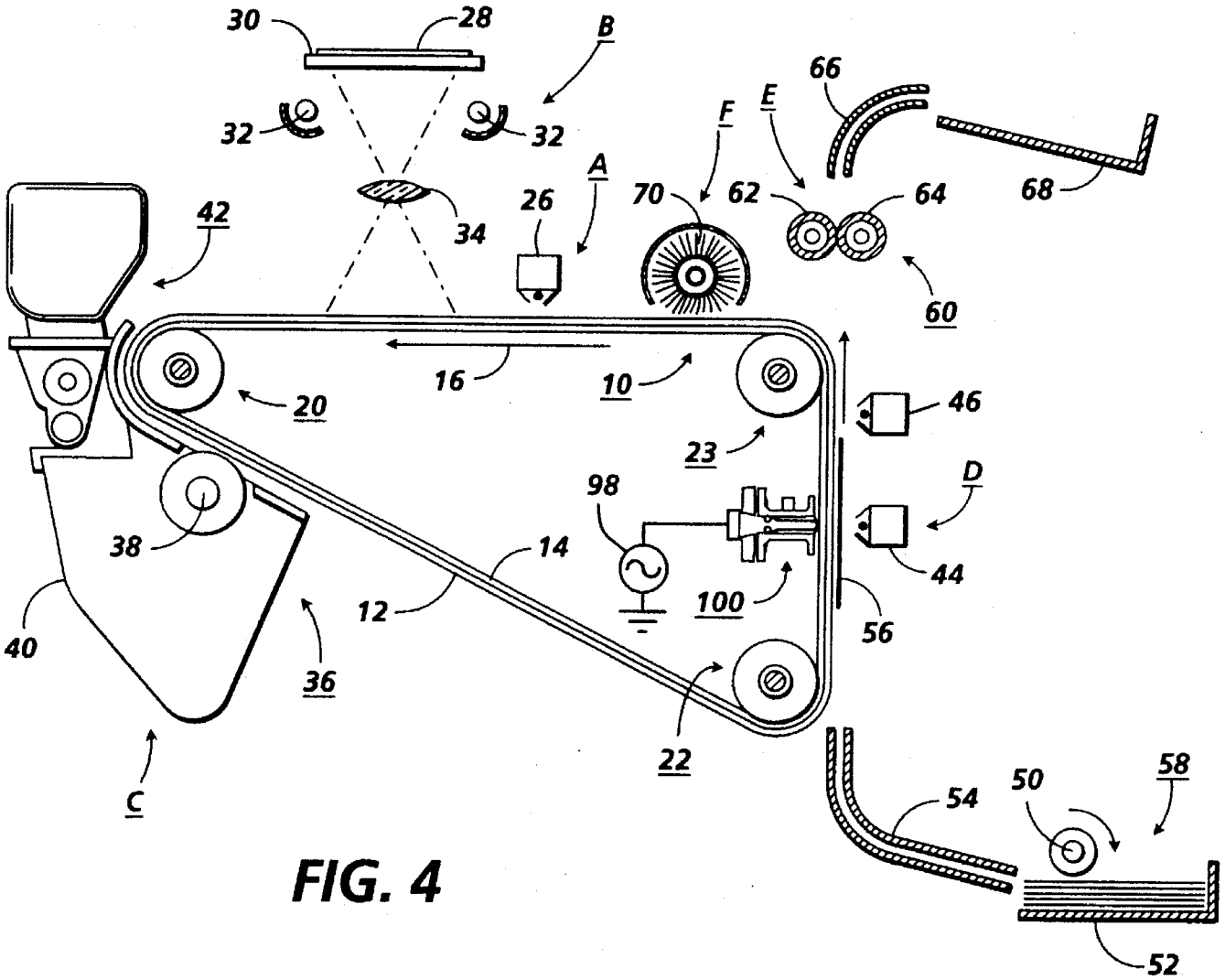
FIG. 4 is a schematic side view of an illustrative electrophotographic reproducing machine including an exemplary transfer station incorporating the resonator of the present invention.

For a general understanding of an exemplary printing machine incorporating the features of the present invention, a schematic depiction of the various processing stations, and the machine components thereof, is provided in FIG. 4. Although the resonator arrangement of the present invention is particularly well adapted for use with a transfer subsystem in an automatic electrophotographic reproducing machine as shown in FIG. 4, it will become apparent from the following discussion that the assembly of the present invention is equally well suited for use in a wide variety of electrostatographic processing machines as well as many other known printing systems. It will be further understood that the present invention is not necessarily limited in its application to a transfer subsystem and may also be useful in other subsystems in which particle adhesion/cohesion forces are desirably reduced, such as a development or cleaning subsystem, for example, it will be further appreciated that the present invention is not necessarily limited to the particular embodiment or embodiments shown and described herein.

Thus, prior to discussing the features and aspects of the present invention in detail, a schematic depiction of an exemplary electrophotographic reproducing machine incorporating various subsystems is furnished in FIG. 4, wherein an electrophotographic reproducing apparatus employs a belt 10, including a photoconductive surface 12 deposited on an electrically grounded conductive substrate 14. Drive roller 22 is coupled to a motor (not shown) by any suitable means, as for example a drive belt, and is further engaged with belt 10 for transporting belt 10 in a process direction of travel indicated by arrow 16. The process direction 16 is a curvilinear path defined by drive roller 22, and rotatably mounted tension rollers 20, 23. This system of rollers 20, 22, 23 is used for advancing successive portions of photoconductive surface 12 through various processing stations, disposed about the path of movement thereof, as will be described.

Initially, a segment of belt 10 passes through charging station A. At charging station A, a corona generating device or other charging apparatus, indicated generally by reference numeral 26, charges photoconductive surface 12 to a relatively high, substantially uniform potential.

Once charged, the photoconductive surface 12 is advanced to imaging station B where an original document 28, positioned face down upon a transparent platen 30, is exposed to a light source, i.e., lamps 32. Light rays from the light source are reflected from the original document 28 for transmission through a lens 34 to form a light image of the original document 28 which is focused onto the charged portion of photoconductive surface 12. The imaging process has the effect of selectively dissipating the charge on the photoconductive surface 12 in areas corresponding to non-image areas on the original document 28 for recording an electrostatic latent image of the original document 28 onto photoconductive surface 12. Although an optical imaging system has been shown and described herein for forming the light image of the information used to selectively discharge the charged photoconductive surface 12, one skilled in the art will appreciate that a properly modulated scanning beam of energy (e.g., a laser beam) or other means may be used to irradiate the charged portion of the photoconductive surface 12 for recording a latent image thereon.

After the electrostatic latent image is recorded on photoconductive surface 12, belt 10 advances to development station C where a magnetic brush development system, indicated generally by reference numeral 36, deposits particulate toner material onto the electrostatic latent image. Preferably, magnetic brush development system 36 includes a developer roll 38 disposed in a developer housing 40. Toner particles are mixed with carrier beads in the developer housing 40, generating an electrostatic charge which causes the toner particles to cling to the carrier beads, thereby forming the developing material. The magnetic developer roll 38 is rotated in the developer housing 40 to attract the developing material to form a "brush" comprising the developer roll 38 with carrier beads with toner particles magnetically attached thereto. As the developer roller 38 continues to rotate, the brush contacts belt 10 where developing material is brought into contact with the photoconductive surface 12 such that the latent image thereon attracts the toner particles from the developing material to develop the latent image into a visible image. A toner particle dispenser, indicated generally by reference numeral 42, is also provided for furnishing a supply of additional toner particles to housing 40 in order to sustain the developing process.

After the toner particles have been deposited onto the electrostatic latent image for creating a toner image thereof, belt 10 becomes an image bearing support surface and advances the developed image thereon to transfer station D. At transfer station D, a sheet of support material 56, such as paper or some other type of copy sheet or substrate, is moved into contact with the developed toner image on belt 10 via sheet feeding apparatus 58 and chute 54 for synchronously placing the support material 56 into contact with the developed toner image. Preferably, sheet feeding apparatus 58 includes a feed roller 50 which rotates while in frictional contact with the uppermost sheet of stack 52 for advancing sheets of support material 56 into chute 54, which guides the support material 56 into contact with photoconductive surface 12 of belt 10. The developed image on photoconductive surface 12 thereby contacts the advancing sheet of support material 56 in a precisely timed sequence for transfer thereto at transfer station D. A corona generating device 44 is also provided for charging the support material 56 to a potential so that the toner image is attracted from the surface 12 of photoreceptor belt 10 to the support material 56 while the support material 56 is also electrostatically tacked to photoreceptor belt 10.

With particular reference to the principle of enhanced toner release as provided by a vibratory energy assisted transfer system, the exemplary transfer station D of FIG. 4 includes a vibratory energy producing device or resonator 100 which may include a relatively high frequency acoustic or ultrasonic transducer driven by an AC voltage source 98. The resonator 100 is arranged in vibratory relationship with the back side of belt 10 at a position corresponding to the location of transfer corona generating device 44 for applying vibratory energy to the belt 10 and for agitating the toner developed in imagewise configuration thereon to provide mechanical release of the toner particles from the surface of the belt 10. The vibratory energy enhances toner transfer by dissipating the attractive forces between the toner particles and the belt 10. In a preferred arrangement, the resonator 100 is configured such that the vibrating surface thereof is parallel to photoconductive belt 10 and transverse to the direction of belt movement 16, with a length approximately co-extensive with the belt width. The belt 10 has the characteristic of being non-rigid, or somewhat flexible, to the extent that it can be effected by the vibrating motion of the resonator 100, thereby providing mechanical release of the toner from the surface of belt 10 and allowing more efficient electrostatic attraction of the toner to a copy sheet during the transfer step.

Vibratory assisted transfer, as provided by resonator 100, also provides increased transfer efficiency with lower than normal transfer fields. Such increased transfer efficiency not only yields better copy quality, but also results in improved toner use as well as a reduced load on the cleaning system. Exemplary vibratory transfer assist subsystems are described in U.S. Pat. Nos. 4,987,456, 5,016,055 and 5,081,500 , among various other commonly assigned patents, which are incorporated in their entirety by reference into the present application for patent. Further details of vibratory assisted toner release in electrostatographic applications can also be found in an article entitled "Acoustically Assisted Xerographic Toner Transfer", by Crowley, et al., published by The Society for Imaging Science and Technology (IS&T) Final Program and Proceedings, 8th International Congress on Advances in Non-Impact Printing Technologies, Oct. 25–30, 1992. The contents of that paper are also incorporated by reference herein.

Continuing with a description of the exemplary electrophotographic printing process, after the transfer step is completed, a corona generator 46 charges the support material 56 with an opposite polarity to release the support material from belt 10, whereupon the support material 56 is stripped from belt 10. The support material 56 is subsequently separated from the belt 10 and transported to a fusing station E. It will be understood by those of skill in the art, that the support material may also be an intermediate surface or member, which carries the toner image to a subsequent transfer station for transfer to a final support surface. These types of surfaces are also charge retentive in nature. Further, while belt type members are described herein, it will be recognized that other substantially non-rigid or compliant members may also be used with the invention.

Fusing station E includes a fuser assembly, indicated generally by the reference numeral 60, which preferably comprises a heated fuser roll 62 and a support roll 64 spaced relative to one another for receiving a sheet of support material 56 therebetween. The toner image is thereby forced into contact with the support material 56 between fuser rollers 62 and 64 to permanently affix the toner image to support material 56. After fusing, chute 66 directs the advancing sheet of support material 56 to receiving tray 68 for subsequent removal of the finished copy by an operator.

Invariably, after the support material 56 is separated from belt 10, some residual developing material remains adhered to the photoconductive surface 12 thereof. Thus, a final processing station, namely cleaning station F, is provided for removing residual toner particles from photoconductive surface 12 subsequent to transfer of the toner image to the support material 56 from belt 10. Cleaning station F can include a rotatably mounted fibrous brush 70 for physical engagement with photoconductive surface 12 to remove toner particles therefrom by rotation thereacross. Removed toner particles are stored in a cleaning housing chamber (not shown). Cleaning station F can also include a discharge lamp (not shown) for flooding photoconductive surface 12 with light in order to dissipate any residual electrostatic charge remaining thereon in preparation for a subsequent imaging cycle. As previously noted, the cleaning station may also include a vibratory resonator arranged in a manner similar to resonator 100 for aiding in the removal of toner particles from belt 10.

The various machine functions described hereinabove are generally managed and regulated by a controller (not shown), preferably provided in the form of a programmable microprocessor. The microprocessor controller provides electrical command signals for operating all of the machine subsystems and printing operations described herein, including imaging onto the photoreceptor, paper delivery, xerographic processing functions associated with developing and transferring the developed image onto the paper, and various functions associated with copy sheet transport and subsequent finishing processes. As such, the controller initiates a sequencing schedule which is highly efficient in monitoring the status of a series of successive print jobs which are to be printed and finished in a consecutive fashion. Conventional sheet path sensors or switches are also utilized in conjunction with the controller for keeping track of the position of documents and the sheets in the machine. In addition, the controller regulates the various positions of gates and switching mechanisms, which may be utilized depending upon the system mode of operation selected. The controller may provide time delays, jam indications and fault actuation, among other things. The controller generally provides selectable option capabilities via a conventional user interface which allows operator input through a console or graphic user interface device (not shown) coupled to the controller.

The foregoing description should be sufficient for the purposes of the present disclosure to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

Figure 1:
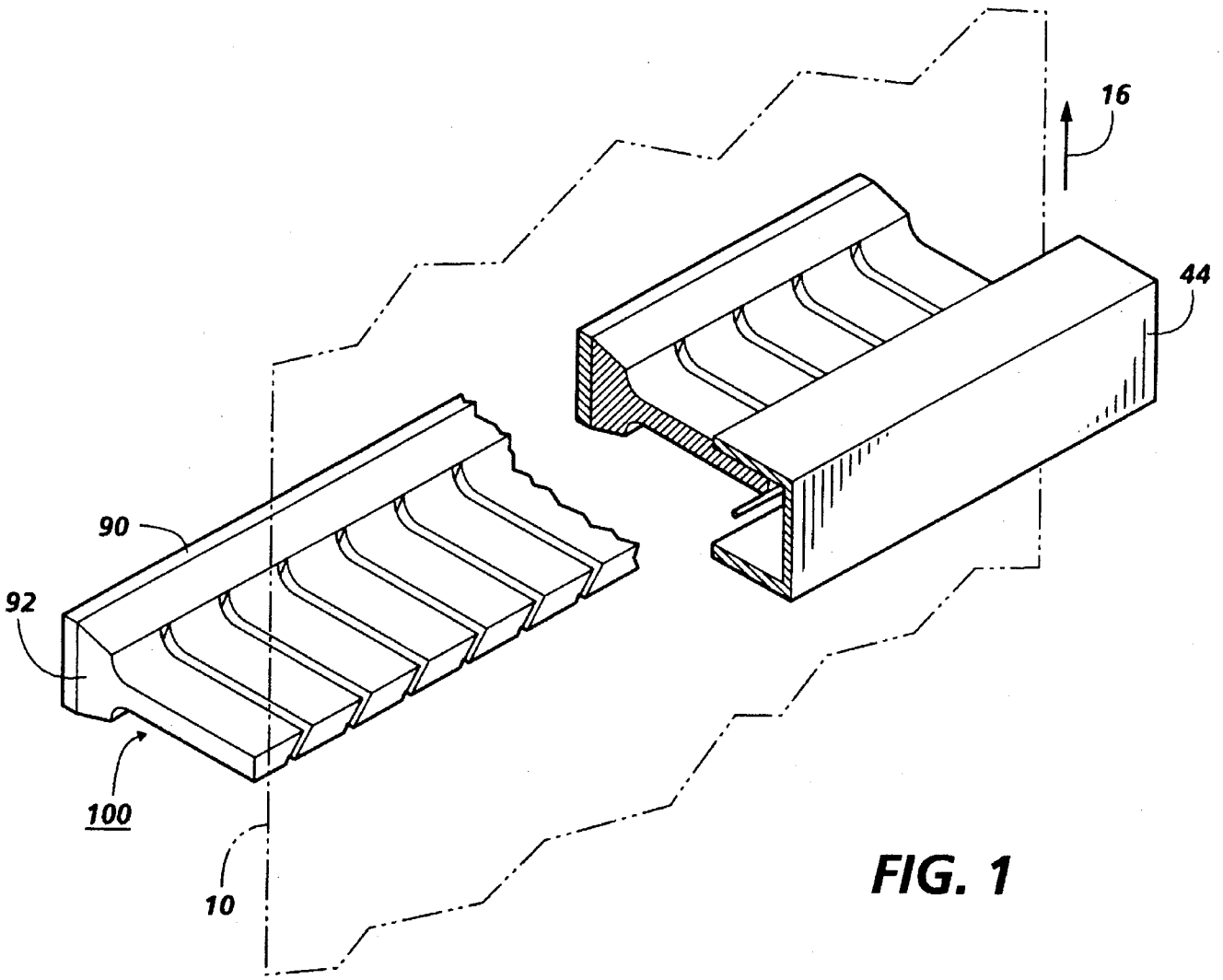
FIG. 1 is a partially broken away, cross sectional view of a resonator in its operating environment adjacent an image bearing member, wherein the resonator includes an angularly segmented waveguide in accordance with the present invention.

With particular reference to FIG. 1, and as previously discussed, the principle of enhanced toner release as provided by the vibratory energy assisted transfer system described hereinabove is facilitated by a relatively high frequency acoustic or ultrasonic resonator 100 situated substantially in contact with the back side of belt 10, at a position in alignment with corona generating device 44. In a preferred arrangement, the resonator 100 is arranged with a vibrating surface parallel to belt 10 and transverse to the direction of belt movement 16, with a length approximately co-extensive with the belt width. The belt described herein has the characteristic of being non-rigid, or somewhat flexible, to the extent that it it can be made to follow the resonator vibrating motion.

The resonator 100 generally comprises a piezoelectric transducer 90 driven by an A.C. voltage source 98. The resonator is generally operated at a frequency between 20 kHz and 200 kHz and typically at approximately 60 kHz. A horn or waveguide member 92 is coupled to the piezoelectric transducer 90 for transmitting the vibratory energy generated therefrom to the belt 10. The waveguide member 92 is preferably fabricated from aluminum and may be provided via various shapes and structures, as discussed in U.S. Pat. No. 4,987,456. An adhesive epoxy and conductive mesh layer or other materials may be used to bond the transducer 90 and waveguide member 92 together without the requirement of a backplate or other mechanical coupling devices.

In order to provide a coupling arrangement for transmitting vibratory energy from the resonator 100 to the photoreceptor belt 10, the resonator may be arranged in association with a vacuum arrangement, as shown in the prior art. For example, the resonator 100 may be configured in association with a so called vacuum plenum (not shown) which may be of a type disclosed in U.S. Pat. No. 5,357,324 (incorporated by reference herein). The vacuum plenum arrangement is advantageously utilized to draw belt 10 into positive contact with the resonator so that horn 92 imparts the vibratory energy of the resonator 100 to belt 10. A coupling cover (not shown) may also be provided at the interface between the waveguide member and the photoreceptor belt to create a replaceable protective coupling attachment for extending the functional life of the resonator 100, and in particular, the waveguide portion thereof, as well as the life of the photoreceptor belt 10. The resonator coupling cover advantageously protects the resonator from wear and minimizes the effect of a torque spike occurring from contact with the seam of the photoreceptor belt 10 while enhancing toner release provided by the vibratory energy assisted transfer system by creating a damping effect for eliminating image quality defects caused by perturbation of vibrational energy outside the region of transfer. The particular features of the resonator coupling cover and horn waveguide, as well as various embodiments therefor, are discussed in detail in the various publications referenced herein.

As previously discussed, it is highly desirable for the waveguide member 92 to produce a uniform response along its length, or image defects caused by nonuniform transfer characteristics may result. It is also highly desirable to have a unitary structure for efficient manufacturing and effective application requirements. Thus, in accordance with known resonators utilized in the welding arts, the tip portion of waveguide member 92 is cut perpendicularly to the plane of the image bearing surface, and generally parallel to the process direction of travel thereof, while a continuous piezoelectric transducer 90 is maintained. Such an arrangement produces an array of horn segments along a longitudinal axis and provides a frequency or velocity response along the length of the waveguide member 92 which tends toward uniformity across the contacting tip. It is also noted that the velocity response is greater across the segmented horn tip as compared to an unsegmented horn tip, a desirable result.

Thus, systems incorporating a resonator for applying uniform vibratory energy to the photoreceptor belt typically incorporate segmentation of the waveguide member so as to divide the waveguide into individually vibrating portions. Such segmentation is accomplished by providing widthwise slots positioned along the length, or the longitudinal axis, of the waveguide member such that the waveguide 92 is cut perpendicularly to the plane of the photoconductive surface, and generally parallel to the process direction of travel of the photoconductive surface 12, perpendicular to the longitudinal axis of the resonator assembly. The waveguide member is generally cut through the contacting tip of the waveguide member 92, while a continuous platform portion adjacent to the transducer 90 is maintained. With the waveguide 92 fully segmented, each waveguide member segment tends to act as an individual waveguide member with each segment acting more or less individually in response to the transducer 90. Alternatively, a fully segmented resonator may be provided with a segmented transducer 90 in conjunction with a partially segmented waveguide member, cut through the contacting tip and through a tip portion extending to a platform portion, with the platform portion remaining continuous in the area adjacent to the segmented transducer. This alternative embodiment allows for individually applying voltage across each transducer segment in order to tailor frequency response across the length of the resonator. Thus, nonuniform frequency response may be compensated by causing the transducer of the resonator to be segmented into a series of individual resonator devices with each transducer segment having a separate driving signal.

Figure 2:
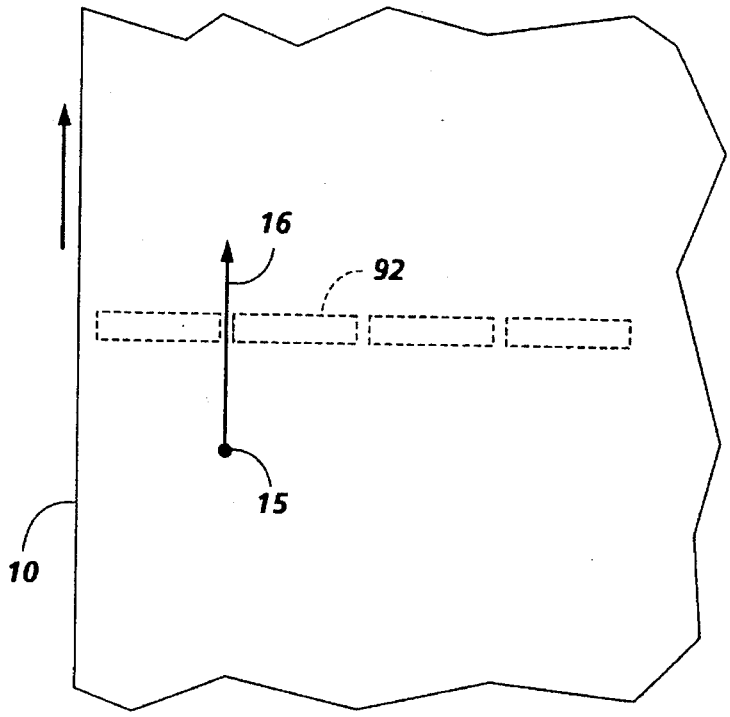
FIG. 2 PRIOR ART
FIG. 2 is a schematic plan view of a segmented waveguide in accordance with the prior art.

While segmentation of the resonator device as described hereinabove generally provides beneficial results with respect to uniformity of frequency response across the length of the resonator, it is noted that some negative side effects may also result, particularly in electrostatographic applications. In particular, segmentation of the waveguide member creates an open-ended slot between each segment such that the finite slot width through the waveguide tip can create a disjoining of the inertial energy propagated by the waveguide member, resulting in the generation of streaks during the transfer process. This phenomenon is illustrated with reference to FIG. 2, wherein it can be seen that the finite slot width between waveguide segments 92, which is parallel to the process direction 16 of travel of the photoconductive surface 12, creates vibratory energy voids which result in the absence of vibratory energy at a position on the photoreceptor belt 10 corresponding to the slot. Thus, a toner particle 15 situated on the photoreceptor belt 10, in alignment with the segmentation slot will not be effected by the vibratory energy of the resonator as the photoreceptor belt travels in a process direction 16 parallel to the slot, such that the toner particle may not be transferred over from the photoreceptor belt to a copy sheet. This problem is exacerbated in high speed machines and may result in the presence of unacceptable visible blank streaks in the output copy sheet.

Figure 3:
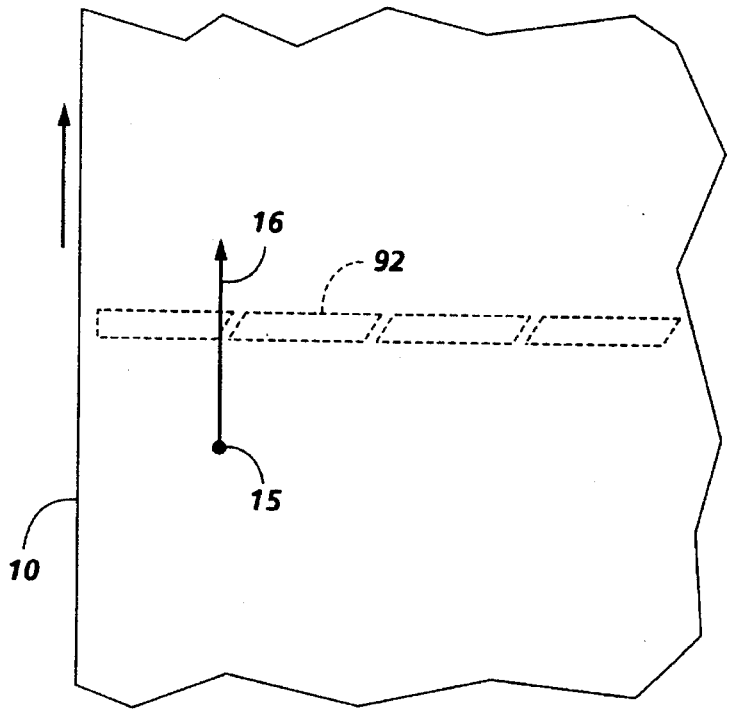
FIG. 3 is a schematic plan view of an angularly segmented waveguide in accordance with the present invention.

The present invention is directed toward the problems associated with resonator segmentation in a resonator arrangement as described herein by eliminating the presence of vibratory energy voids across the width of the photoreceptor belt. Referring to FIG. 3, the problem is addressed by providing segmentation slots in the resonator oriented at an angle relative to the process direction 16 of the image bearing photoreceptor belt 10. Such angularly oriented segmentation slots may also be characterized as having an orientation generally non-perpendicular to the longitudinal axis of the resonator, or having an orientation generally non-parallel to the process direction of movement of the photoreceptor belt 10. By forming the segmentation slots at an angle with respect to the process direction 16 of the belt 10 so that the segmentation slots are non-parallel to the process direction of movement of the photoreceptor belt 10, the vibratory energy generated by a given segment will overlap the vibratory energy of a neighboring segment so as to apply vibratory energy in a continuous manner across the entire width of the belt, thereby eliminating any disjoinder of the energy applied across the width of the belt.

Thus, as illustrated in FIG. 3, a toner particle 15 on the photoreceptor belt 10 will be assured of being effected by the vibratory energy of the resonator as the photoreceptor belt travels in a process direction 16 regardless of where the toner particle 15 is situated. By creating segmentation slots which are non-perpendicular to the longitudinal axis of the resonator, vibratory energy voids across the width of the photoreceptor belt are eliminated such that a toner particle will be exposed to the vibratory energy produced by the resonator independent of where the toner particle is situated on the photoreceptor belt. Thus, the angularly oriented segmentation of the present invention assures that the benefits of enhanced toner transfer as provided by a resonator will be applied in a continuous manner across the width of the photoreceptor belt to enhance toner particle release from the photoreceptor belt and transfer over to a copy sheet. The minimum angle of the slot orientation is determined as a function of both the tip contacting width and the slot width, resulting in a overlapping vibratory energy continuum with respect to the process width.

It is noted that angling the segmentation slot orientation with respect to the process direction of travel of the photoreceptor belt provides benefits that go beyond improved transfer performance. That is to say that precise tolerances must be met in the fabrication process that creates the slots which provide segmentation; these slots generally cannot exceed a maximum width at the point of contact with the photoconductive surface without causing image defects. As a result, expensive techniques such as precision Electronic Discharge Machining (EDM) must be utilized to provide this narrow width segmentation. The angled slot formation of the present invention permits some relaxation of these precision manufacturing tolerances including, in particular, increased segmentation slot width, which, in turn, permits the substitution of well known and less expensive gang slit saw manufacturing techniques for the more expensive EDM process. The resultant cost savings have been shown to be significant. In an alternative embodiment, it is contemplated that slotting may be formed by angling only the tip portion of the slot, subsequently straightening the slot as the hot wire electronic discharge machining wire plunges through the waveguide member. While this alternate technique suggests a method by which the vibratory energy disjoining of the transducer tip may be eliminated, this approach does not lend itself to inexpensive gang slit saw machining.

With reference again to FIG. 4, it will no doubt be appreciated that the inventive resonator arrangement may find application as a means for improving uniformity of application of vibratory energy to a flexible member for the release of toner therefrom for providing various uses in electrophotographic applications. One example of a use may be in causing release of toner from a toner bearing donor belt, arranged in a development position with respect to a latent image. The resonator of the present invention has equal application in the cleaning station of an electrophotographic device with little variation. Accordingly, a resonator assembly in accordance with the present invention may be arranged in close relationship to the cleaning station F, for the mechanical release of toner from the surface prior to cleaning. Additionally, it will be understood by those of skill in the art that improvement in preclean treatment may occur with application of vibratory energy simultaneously with preclean charge leveling.

In review, the present invention describes a resonator for use in electrostatographic applications. The resonator is preferably incorporated into a toner transfer system for enhancing transfer of toner from an image bearing member moving in a process direction, generally transverse to the process direction of movement thereof, for applying uniform vibratory energy thereto. The resonator comprises a vibratory energy producing element for generating the vibratory energy and a waveguide member coupled to the vibratory energy producing element for directing the vibratory energy to the adjacent surface, wherein the waveguide member is divided along a longitudinal axis thereof for forming a plurality of waveguide segments, each waveguide segment being separated by a segmentation slot having an orientation generally non-parallel to the process direction of movement of the image bearing member.

It is, therefore, evident that there has been provided, in accordance with the present invention, a resonator assembly that fully satisfies the aims and advantages of the present invention as hereinbefore set forth. While this invention has been described in conjunction with a preferred embodiment and method therefor, it is evident that many alternatives, modifications, and variations will be apparent to those skilled in the art. Accordingly, it is intended to embrace all such alternatives, modifications and variations as fall within the spirit and broad scope of the appended claims.

I claim:

1. A system for enhancing transfer of toner from an image bearing member moving in a process direction, comprising:

a resonator assembly adapted to contact the image bearing member, generally transverse to the process direction of movement thereof, for applying uniform vibratory energy thereto, including:

a vibratory energy producing element for generating the vibratory energy; and a waveguide member coupled to said vibratory energy producing element for directing the vibratory energy to the image bearing member, said waveguide member being divided along a longitudinal axis thereof for forming a plurality of waveguide segments, each waveguide segment being separated by a segmentation slot having an orientation generally non-parallel to the process direction of movement of the image bearing member.

2. The system of claim 1, wherein said waveguide member includes:

a contacting portion; and a platform portion, wherein the segmentation slot extends from said contacting portion to said platform portion.

3. The system of claim 1, wherein said vibratory energy producing element includes a substantially continuous piezoelectric element having a direction of vibration generally perpendicular to image bearing member.

4. The system of claim 1, wherein said vibratory energy producing element includes a plurality of piezoelectric elements corresponding to said plurality of waveguide segments, said piezoelectric elements having a direction of vibration generally perpendicular to the image bearing member.

5. The system of claim 1, wherein the segmentation slot is created by means of a gang slit saw manufacturing technique.

6. The system of claim 1, further including a vacuum apparatus for drawing the image bearing member toward said resonator assembly.

7. The system of claim 6, wherein said vacuum apparatus includes a vacuum plenum defining an opening adjacent the image bearing member, wherein said vacuum apparatus provides sufficient force at said vacuum plenum opening to draw the image bearing member toward said resonator assembly.

8. The system of claim 1, further including means for electrostatically attracting the toner from the image bearing member.

9. The system of claim 8, wherein said resonator assembly and said electrostatic attracting means are in substantial alignment with one another.

10. An electrostatographic printing apparatus having a system for enhancing transfer of toner from an image bearing member moving in a process direction including a resonator assembly adapted to contact the image bearing member, generally transverse to the process direction of movement thereof, for applying uniform vibratory energy thereto, comprising:

a vibratory energy producing element for generating the vibratory energy; and a waveguide member coupled to said vibratory energy producing element for directing the vibratory energy to the image bearing member, said waveguide member being divided along a longitudinal axis thereof for forming a plurality of waveguide segments, each waveguide segment being separated by a segmentation slot having an orientation generally non-parallel to the process direction of movement of the image bearing member.

11. The electrostatographic printing apparatus of claim 1, wherein said waveguide member includes:

a contacting portion; and a platform portion, the segmentation slot extending from said contacting portion to said platform portion.

12. The electrostatographic printing apparatus of claim 11, wherein said vibratory energy producing element includes a substantially continuous piezoelectric element having a direction of vibration generally perpendicular to the image bearing member.

13. The electrostatographic printing apparatus of claim 6, wherein said vibratory energy producing element includes a plurality of piezoelectric elements corresponding to said plurality of waveguide segments, said piezoelectric elements having a direction of vibration generally perpendicular to the image bearing member.

14. The electrostatographic printing apparatus of claim 10, further including a vacuum apparatus for drawing the image bearing member toward said resonator assembly, said vacuum apparatus including a vacuum plenum defining an opening adjacent the image bearing member, wherein said vacuum means provides sufficient force at said vacuum plenum opening to draw the image bearing member toward said resonator assembly.

15. The electrostatographic printing apparatus of claim 10, further including means for electrostatically attracting the toner from the image bearing member.

16. The electrostatographic printing apparatus of claim 15, wherein said resonator assembly and said electrostatic attracting means are in substantial alignment with one another.

* * * * *